United States Patent [19]

Rhoads

[11] Patent Number: 4,977,867

[45] Date of Patent: Dec. 18, 1990

[54] SELF-ADJUSTING VARIABLE DURATION HYDRAULIC LIFTER

[76] Inventor: Jack L. Rhoads, P.O. Box 830, Taylor, Ariz. 85939

[21] Appl. No.: 502,768

[22] Filed: Apr. 2, 1990

Related U.S. Application Data

[63] Continuation-in-part of Ser. No. 398,883, Apr. 3, 1990, Pat. No. 4,913,106.

[51] Int. Cl.[5] ..... F01L 1/16; F01L 1/24

[52] U.S. Cl. ..... 123/90.49; 123/90.55; 123/90.57

[58] Field of Search ..... 123/90.48, 90.49, 90.52, 123/90.53, 90.55, 90.57

[56] References Cited

U.S. PATENT DOCUMENTS

| | | | |
|---|---|---|---|
| 2,908,260 | 10/1959 | Bergmann | 123/90.57 |
| 3,921,609 | 11/1975 | Rhoads | 123/90.55 |
| 4,524,731 | 6/1985 | Rhoads | 123/90.55 |
| 4,601,268 | 7/1986 | Rhoads | 123/90.57 |
| 4,671,221 | 6/1987 | Geringer et al. | 123/90.12 |
| 4,765,288 | 8/1988 | Linder et al. | 123/90.57 |
| 4,881,499 | 11/1989 | Dietrich et al. | 123/90.52 |
| 4,913,106 | 4/1990 | Rhoads | 123/90.49 |

*Primary Examiner*—Charles J. Myhre
*Assistant Examiner*—Weilun Lo
*Attorney, Agent, or Firm*—Ralph S. Branscomb

[57] ABSTRACT

A self-adjusting variable duration hydraulic lifter utilizes two plungers within the cylindrical lifter body which move together to shorten the overall top-to-bottom length of the internal plunger pair during the valve opening cycle of the engine at low RPM's to improve engine performance. A pre-established gap between the two plungers establishes the bleed down amount for the lifter at low RPM, and the gap is self-adjusting in that it will remain the same over the lifetime of the engine despite changes in the overall length of the valve train and heat compensation effected by the hydraulic mechanism effected by the lifter.

9 Claims, 2 Drawing Sheets

SELF-ADJUSTING VARIABLE DURATION HYDRAULIC LIFTER

BACKGROUND OF THE INVENTION

The present patent application is a continuation-in-part of application Ser. No. 398,883, which will issue Apr. 3, 1990 as U. S. Pat. No. 4,913,106.

The purpose of the invention is to provide a variable duration hydraulic lifter that consistently leaks down a precise and pre-determined amount at low RPM, without sacrificing the self-adjusting benefits of a standard hydraulic lifter, and self-adjusts so that the leak down distance is maintained substantially uniform independently of heat expansion and wear in the valve train which causes the hydraulic system to adjust the effective lifter height.

Hydraulic lifters are designed to maintain zero clearance at all times, even when valve train loosens up and would otherwise increase clearance. When the valve train loosens due to wear or other factors, a hydraulic lifter displaces the extra clearance with oil and maintains zero clearance. If a solid lifter were used instead of an hydraulic, valve clearance would continue to widen, requiring a periodic re-adjustment every several thousand miles or so. With a hydraulic lifter, an engine can run 100,000 miles or more with no need for adjustment, making them virtually maintenance-free.

The invention of the parent patent of this case discloses a variable duration hydraulic lifter which operates with a precise leak-down amount by means of a special adjustment, but the design is not self-adjusting and would require periodic adjustments over the life of the vehicle as would a non-hydraulic lifter.

The principle purpose of the invention of the parent patent to this case and this patent application is the reduction of valve tapping. Prior lifters disclosed in patents issued to the applicant herein and to his father before him, had a continuous leak-down feature such that the effective length of the valve train shortened throughout the entire valve opening cycle. This had the effect that the valve train was still shortening upon the seating of the valve, causing it to seat at an increased speed and make a noticeable tapping noise. Although the tapping noise does not damage the engine, some people find it disconcerting, and a manufacturer of a competing product seized upon the tapping in its promotional materials as a way to promote its own quieter, but less effective lifters.

The invention of the parent patent reduces low RPM tapping by using a combination of a longer closing ramp on the cam and an internal plunger in the lifter which bleeds down and bottoms out prior to valve seating at low RPM. Both of these features reduce the seating velocity of the valve, and thus reduce tapping. However, the bleed down distance at low RPM is tied to the overall length adjustment of the hydraulic lifter, and thus would require periodic adjustment.

A variable duration hydraulic lifter is needed that will leak down a precise predetermined amount at low RPM, but at the same time will be self-adjusting.

SUMMARY OF THE INVENTION

This invention fulfills the above stated need and the principal embodiment utilizes a dual plunger system in which the two plungers are separated a predetermined distance when the valve is closed, but as the intake cycle begins, the hydraulic fluid between the plungers is permitted to leak out so that the plungers move together, effectively shortening the valve train during the opening cycle. At some point during the low RPM valve opening cycle, the two plungers come into contact to prevent further shortening of the valve train and thus eliminate further acceleration of the valve into its seat to minimize tapping.

The hydraulic fluid reservoir between the two plungers is returned to the interplunger space, or "gap", during the part of the cycle in which the valve is closed, reestablishing the gap to the same, pre-set dimension independently of the overall valve adjusting mechanism, so that the re-established gap, and thus the leak-down distance between the plungers, is self-adjusting.

DETAILED DESCRIPTION OF THE PREFERRED EMBODIMENTS

Figure 1:
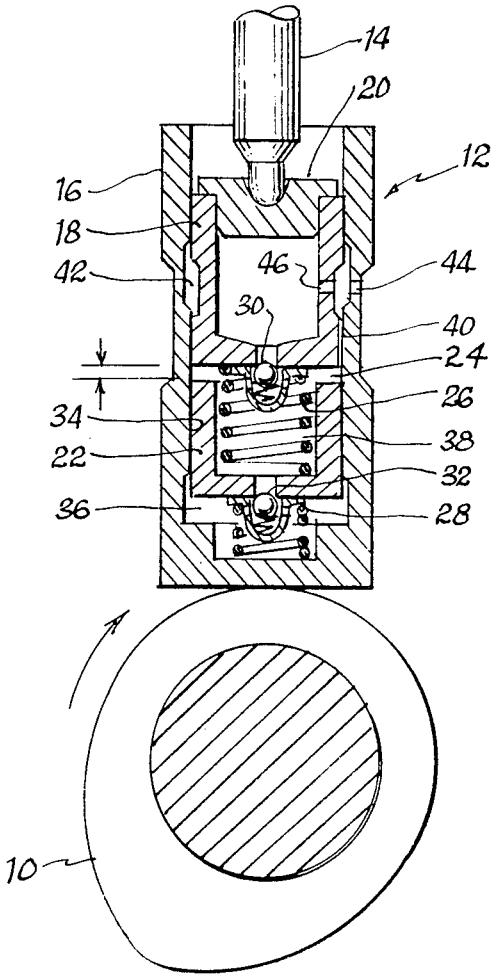
FIG. 1 is an illustration of the lifter with the plungers fully expanded.
Figure 2:
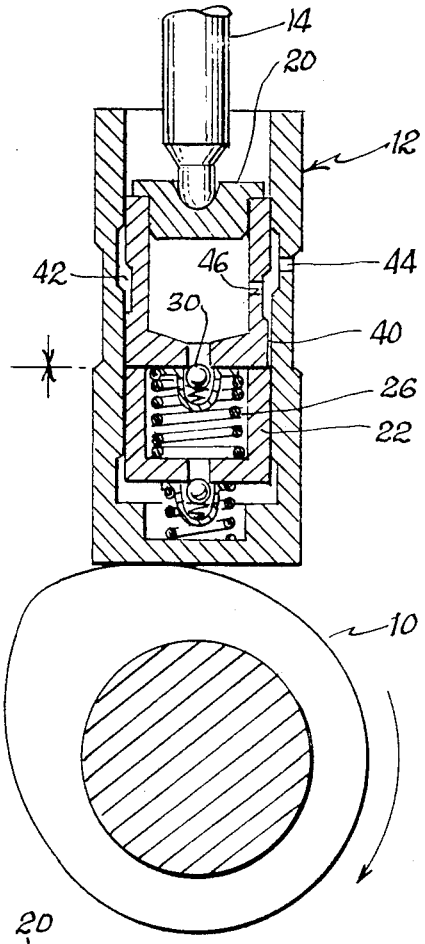
FIG. 2 is an illustration of the lifter after the plungers have been forced together during the lift cycle.
Figure 3:
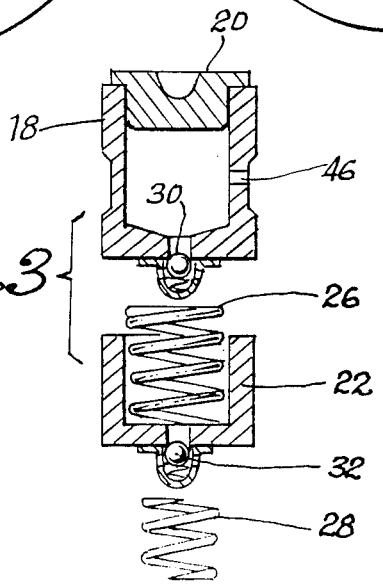
FIG. 3 is an expanded section view of the internal plungers of FIGS. 1 and 2.

There are three embodiments of the invention, with the second two being substantially identical functionally, and the first one functioning in a slightly different manner. The first embodiment is illustrated in FIGS. 1 through 3.

The portion of the valve train pertinent to the invention includes the cam 10, the hydraulic lifter 12, and the rod 14, whose up and down movement ultimately controls the opening and closing of the valve in its seat. Any kind of lifter body could be used—flat bottom, as shown, lifters having rollers on the bottoms, pivotal lifters and any other kind of lifters known to man.

The lifter has a cylindrical external body 16 with a cylindrical internal bore. An upper plunger 18 slides axially in the bore and supports the rod on the cap 20. The basic idea behind the invention is to design a lifter in which the upper plunger 18 sinks down inside the lifter body 16 a predetermined amount and then sinks no further, so that the termination of the sinking occurs during the opening stroke of the cam at low RPM.

In the first embodiment, this is accomplished by utilizing a second, lower internal plunger 22. As shown in FIG. 1, the two plungers are separated by a gap 24, which is pre-established by the manufacturer and would normally be about 0.030 of an inch. The size of the gap is controlled by the length of the internal spring 26, which is stronger than the lower spring 28. Thus with the spring 26 virtually fully expanded, the gap 24 is established. Whereas the internal spring establishes the gap, the lower spring is the usual spring used in hydraulic lifters to maintain compression in the valve train and to "pull in" hydraulic fluid to maintain the valve train in constant proper adjustment.

Illustrated embodiment, each of the plungers is provided with a ball check valve 30 and 32, respectively. These check valves could be other than ball check valves, and it would be possible to omit the upper check valve 30 entirely, and depend on the bleed passageway, described below, to re-fill the gap 24. In any event, the main oil chamber 34 beneath the upper plunger 18 receives oil to re-fill itself through the check valve 30 or through some other passageway. The "oil chamber" has been defined for purposes of the claims to include the entire volume defined by the bottom of the upper plunger and the cylindrical wall of the lower portion of the lifter body.

The lower chamber 36 beneath the lower plunger has no way out other than whatever slight leakage might occur, so there is a minimum flow of hydraulic fluid in and out of chamber 36.

The upper chamber 38, however, communicates with the vehicle oil gallery through some kind of restricted bleed passageway. This could be done in several ways. The check valve 30 could be scored so that it would not seal completely. Or, a very small diameter hole could be drilled through the bottom of the upper plunger. The upper plunger could be of slightly smaller diameter than the inside diameter of the lifter body, creating a "sloppy fit" leak. However, the most practical way, and the way illustrated in the drawings is to mill a slot, or grind a flat 40 into the upper plunger which communicates from the gap area inside the lifter to the annular oil passage recesses 42 which communicates through the orifice 44 to the main oil gallery of the vehicle, and through the orifice 46 of the upper plunger.

As the lifter operates during the engine cycle, it will begin as shown in FIG. 1. The valve is shut and the lift cycle has not yet begun. The strong spring 26 has expanded the plungers to create the maximum gap 24. Under oil line pressure, oil is forced in from the oil gallery through the orifices 44 and 46 inside the upper plunger, and then down through the check valve 30 or bypass, if there is no check valve, filling both upper and lower oil chambers. The valve train is thus lengthened by the width of the gap.

Figure 10:
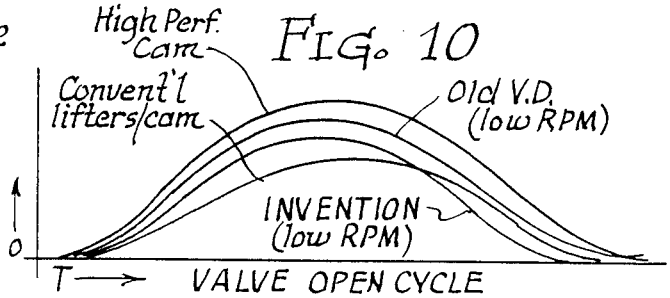
FIG. 10 illustrates diagrammatically the position of a valve over time when different types of lifters are used (this Figure has been taken from the parent case).

As the cam rotates as shown in FIG. 2, because the valve train is lengthened, the valve opens prematurely. At low engine RPM, there would be virtually no premature opening of the valve because lifter operation is relatively slow and oil from the upper oil chamber 34 would quickly leak out through the bleed passageway 40. This would result in the upper plunger "bottoming out" onto the lower plunger early in the cam cycle at low RPM, so that the valve operation would substantially follow the curve illustrated in FIG. 10 and marked "CONVENTIONAL LIFTERS/CAM".

As engine speed gets higher and higher, the gap 24 will disappear over an increasingly later point in the engine's cycle so that at increasingly high RPM, the leak down all but ceases to be a factor. At top speed, the leak down might be 0.002 inch, for example, over the whole lift cycle, compared to 0.030 inch leak down early in the cycle at idling speed.

FIGS. 4 through 9 illustrate two slightly different embodiments which function virtually identically to one another, and produce the same end result as the first embodiment. The parts in these Figures are numbered identically to those discussed above if they are essentially identical in nature or operation even though there may be minor differences in function, size or configuration.

Figure 4:
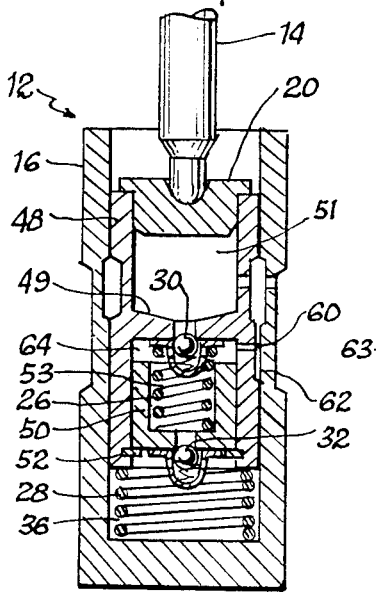
FIG. 4 is a section taken through a first modified form of the invention.
Figure 5:
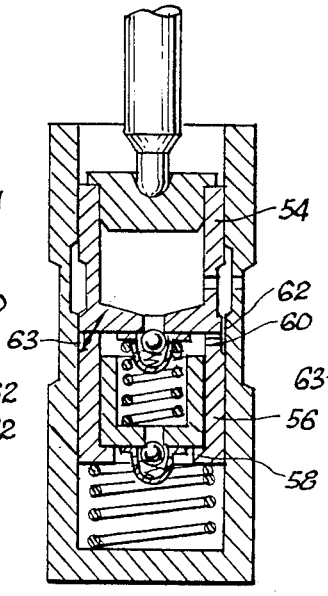
FIG. 5 is a section taken through a second modified form of the invention which is functionally identical to the embodiment illustrated in FIG. 4.
Figure 6:
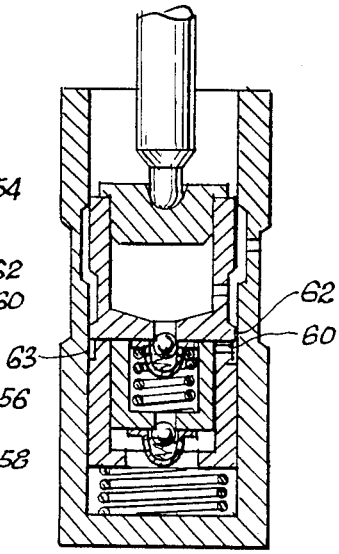
FIG. 6 is a section taken through the lifter of FIG. 5 but with the internal part of the lower plunger being in its fully elevated position.
Figure 7:
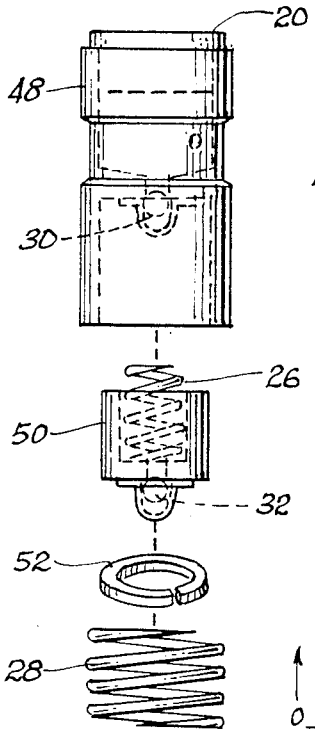
FIG. 7 is an expanded sectional view of the internal parts of the first modification of the invention shown in FIG. 4.

In FIGS. 4 through 9, the first plunger 48 extends well below the check valve 30 which is mounted in a partition 49 which establishes an upper compartment 51 and a lower compartment 53. The lower compartment houses the second plunger 50 as a slidable, internal part of the first plunger. The second plunger is maintained in place by a retainer ring 52. This structure is shown in FIGS. 4 and 7. The only significant difference between this structure and that the embodiment of FIGS. 5 and 6 is that in FIGS. 5 and 6, the first plunger 48 is made in two parts, indicated at 54 and 56, with the bottom part having a retaining lip 58 machined into it so that no retainer ring is needed.

Referring to FIGS. 4 & 7, the first plunger has a bleed orifice 60 or other oil passageway so that oil can bleed from inside the second plunger through to the oil gallery. When the valve is seated, the second plunger 50 is in its lowermost position as shown in FIG. 4, acting under the action of the internal spring 26. As the lobe of the cam moves against the bottom of the lifter to open the valve, the increased hydraulic pressure in the lower chamber 36 overcomes the strength of the spring 26 and oil begins to bleed through the orifice 60 or other oil passageway. Although the oil in the lower chamber 36 cannot escape so the chamber volume is constant, the chamber is in effect longitudinally enlarged by the rising of the second plunger as illustrated in FIG. 6, permitting the first plunger to sink further down in the lifter body as shown in FIG. 6, shortening the length of the valve train. Thus, the valve train is still shortened by the amount of the gap 64 in these embodiments, despite the fact that there is no bottoming out of the plungers in the sense that the plungers do in the embodiment illustrated in FIGS. 1–3.

Because the upper or first plunger 48 is one piece in FIG. 4, the bleed-down will occur through the orifice 60 and the slot or flat 60. However, because 48 is a two-piece plunger in FIGS. 5 and 6, a reduced band 63 in the circumference of the lower part 56 is used to ensure proper oil communication despite angular migration of the upper and lower plunger parts 54 and 56 relative to one another. This band would only need to be about 0.002 inch deep, and is exaggerated in the drawings to reproduce well.

In the two-part versions of FIGS. 5 and 6, the orifice 60 could be replaced by a slightly ruffled surface created in the top of the plunger bottom part 56. This would allow the escape of oil from the chamber 53, although the bleed rate would probably be more difficult to control than with an orifice.

Figure 8:
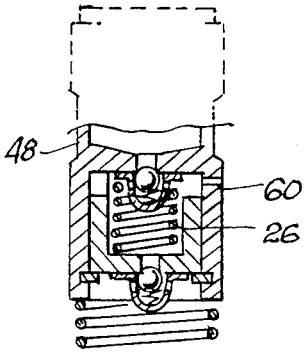
FIG. 8 is a section of a detail of the embodiment of FIGS. 4 and 7 in which the oil bleed opening has been lowered.

As stated above, the gap 64 in the illustrated embodiments determines the amount by which the valve train is shortened during the valve opening cycle. However, physical bottoming out of the second plunger against the first plunger is not the only way to establish the "bottoming out" distance, or gap, 64. Another way is illustrated in FIG. 8, in which the orifice 60 is positioned lower in the first plunger, so that once the second plunger rides up past the orifice, no further oil can bleed out. This prevents the physical abutting contact between the metal plungers. (The orifices 60 in FIGS. 4, 5 and 6 are shown slightly below the top edge of part 56 for clarity, but are actually effectively at the top edge so that bleeding would occur until physical contact was made between the second plunger and the partition 49. The orifice is definitely lowered away from the top edge in FIG. 8.)

Figure 9:
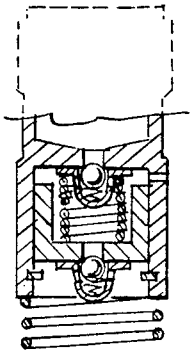
FIG. 9 is a section of the portion of the internal structure of the modification illustrated in FIG. 4, 7, and 8 in which the compression limit of the two plungers is established by the internal coil spring.

FIG. 9 illustrates an embodiment in which the fully compressed length of the internal coil spring 26 exceeds the length inside the second plunger and thus establishes the compression limit of the two plungers without their making physical, butting contact. This technique could also be used in the first embodiment illustrated in FIGS. 1–3.

FIGS. 8 and 9 are shown as modifications of the embodiment of FIGS. 1–3, but could just as well be modifications of the other embodiments.

In any of the embodiments, the leak-down rate is essentially established when the lifter is manufactured, and will maintain itself at the same rate throughout the life of the engine. The overall valve train length will be varied by the self-adjusting feature of the lifter, as with all hydraulic lifters, over the life of the engine but the leak-down gap remains the same and will continue to re-establish itself to the pre-set dimension. This automatic adjustment is independent of the particular setting of the bleed-down amount.

Being the latest in the series of hydraulic lifter improvements, this lifter will not only adjust the valve timing to compensate for high and low speed engine operation, but also reduces the tapping noise of the valves in conjunction with the use of a shallow closing ramp on the cams, as does the parent patent. Beyond the parent patent however, the instant invention provides a self-adjusting bleed-down feature demanded in the construction of modern vehicles.

It is hereby claimed:

1. A self-adjusting controlled bleed-down variable duration hydraulic valve lifter comprising :

(a) a lifter body having a longitudinal cylindrical internal bore and a substantially closed lower end;

(b) an upper plunger axially slideable in said body and defining a main hydraulic oil chamber in the lower portion of said body;

(c) means permitting the entry of oil into said main chamber;

(d) a restricted oil bleed passageway permitting the egress of oil from said chamber at a predetermined rate; and, (e) limit means defining the lowermost level to which said plunger travels in said body, such that at low engine RPM said upper plunger bottoms out at said lowermost level at some point during the valve opening cycle, said limit means comprises a second plunger slidable within said bore, and dividing said main chamber into an upper and a lower chamber, said lower plunger having a check valve for passing oil from said upper chamber to said lower chamber, and a lower spring biasing said lower plunger upward, and said lower plunger seats said upper plunger when adequate oil has exited said upper chamber.

2. Structure according to claim 1 and including an upper spring between said plungers biasing same apart, with said upper spring being stronger than said lower spring such that the reduction of compression between said plungers causes them to separate and enlarge said upper chamber so that the bottom of said first plunger rises to substantially the height established by said upper spring.

3. Structure according to claim 2 wherein said oil bleed passageway comprises an aperture in said upper plunger and an aperture in said body to communicate with the oil gallery of the engine housing the lifter.

4. Structure according to claim 2 wherein said passageway comprises an aperture in said body and spaced between said upper plunger and said bore.

5. A self-adjusting, controlled bleed-down hydraulic valve lifter comprising:

(a) a lifter body having a longitudinal cylindrical internal bore with a closed lower end;

(b) a first plunger means slideably seated in said bore and having a transverse partition defining an upper compartment and a lower compartment;

(c) said lower compartment having cylindrical sidewalls and slideably seating a second plunger;

(d) said second plunger having cylindrical side walls and a bottom wall and defining an upper oil chamber between itself and said partition, and a lower oil chamber between its bottom wall and the lower portion of the lifter body;

(e) an internal spring longitudinally extended in said second plunger;

(f) at least one lower spring in said lower oil chamber biasing at least one of plungers upwardly;

(g) inlet passageway means permitting the ingress of oil into said upper oil chamber;

(h) a limited bleed passageway permitting the oil in said upper chamber to bleed into the engine oil gallery at a limited rate, such that said second plunger rises in said first plunger means to permit the lowering of said first plunger means in said body; and (i) stop means establishing the lowermost limit to which said first plunger means can sink in said body as said oil chamber bleeds oil.

6. Structure according to claim 5 wherein said stop means comprises the top of said second plunger which butts against said partition.

7. Structure according to claim 6 wherein said bleed passageway includes an aperture through the wall of said first plunger means, and said aperture defines said stop means, as the egress of oil from said upper oil chamber ceases when said second plunger rides up beyond said aperture, blocking same.

8. Structure according to claim 5 wherein said internal spring has a completely compressed length dimension greater than the internal height of the cylindrical side wall of said second plunger and defines said stop.

9. Structure according to claim 5 wherein said first plunger means is a two-part plunger, with the upper part comprising a cylindrical side wall and said partition, and a lower part comprising a cylindrical side wall with an inwardly directed retainer at the lower end thereof to retain said second plunger therein.

* * * * *